United States Patent [19]

Dysart

[11] 4,249,622

[45] Feb. 10, 1981

[54] FLOATING SEAL FOR DRILL BITS

[75] Inventor: Theodore R. Dysart, Dallas, Tex.

[73] Assignee: Dresser Industries, Inc., Dallas, Tex.

[21] Appl. No.: 47,416

[22] Filed: Jun. 11, 1979

Related U.S. Application Data

[63] Continuation of Ser. No. 920,868, Jun. 30, 1978, abandoned.

[51] Int. Cl.[3] ..... E21B 10/24

[52] U.S. Cl. ..... 175/227; 175/372; 308/8.2; 184/1 D

[58] Field of Search ..... 175/227–229, 175/371, 372, 373, 337, 340; 308/8.2; 184/1 D

[56] References Cited

U.S. PATENT DOCUMENTS

| | | | |
|---|---|---|---|
| 3,193,028 | 7/1965 | Radzimovsky | 175/372 |
| 3,216,513 | 11/1965 | Robbins et al. | 175/227 |
| 3,476,195 | 11/1969 | Galle | 175/228 |
| 3,719,241 | 3/1973 | Bell | 175/228 |
| 3,903,992 | 9/1975 | Chivukula | 181/1 D |
| 3,942,596 | 3/1976 | Millsapps, Jr. | 175/227 |
| 3,952,815 | 4/1976 | Dysart | 175/374 |
| 3,982,595 | 9/1976 | Ott | 175/373 |
| 4,092,054 | 5/1978 | Dye | 175/337 |
| 4,102,552 | 7/1978 | Kellner | 308/8.2 X |

*Primary Examiner*—William F. Pate, III

*Attorney, Agent, or Firm*—Fred A. Winans; Eddie E. Scott

[57] ABSTRACT

A rolling cone cutter earth boring bit is provided with a floating seal for sealing the bearings of the bit from the abrasive materials in the borehole and retaining lubricant within the bearing area. At least one cantilevered bearing pin extends from the arm of the bit. A cutter receiving surface is located on the arm. A first shallow annular groove is located in said cutter receiving surface. A rolling cone cutter is adapted to be rotatably mounted on the bearing pin with said rolling cone cutter having a cone mouth. A second shallow annular groove is located within said cone mouth. Bearing and cutter retaining means are located between the bearing pin and the cone cutter. A first seal unit is positioned around the bearing pin between the cutter receiving surface and the rolling cone cutter. The first seal unit includes a first annular rigid ring positioned around the bearing pin and a first resilient ring located in the first shallow annular groove between the first annular rigid ring and the cutter receiving surface. A second seal unit is positioned around the bearing pin and located within the cone mouth. The second seal unit includes a second annular rigid ring positioned around the bearing pin within the cone mouth and a second resilient ring located in the second shallow annular groove between the second annular rigid ring and the cone mouth. The first and second seal units cooperate when the rolling cone cutter is mounted on the bearing pin so that the first and second resilient rings urge the first and second annular rigid rings into sliding contact as the cone cutter rotates about the bearing pin.

2 Claims, 2 Drawing Figures

FLOATING SEAL FOR DRILL BITS

This is a continuation of application Ser. No. 920,868, filed June 30, 1978, now abandoned.

BACKGROUND OF THE INVENTION

The present invention relates to the art of rolling cone cutter earth boring bits and, more particularly, to a rolling cone cutter earth boring bit with improved means for sealing the bearings of the bit from the abrasive materials in the borehole and retaining lubricant within the bearing area.

A rolling cone cutter earth boring bit consists of a main bit body adapted to be connected to a rotary drill string. The bit includes individual rotatable cone cutters mounted on individual bearing pins extending from the main bit body. Bearing systems are provided between the cone cutters and the bearing pins to promote rotation of the cutters and means are provided on the outer surface of the cone cutters for disintegrating the earth formations as the bit and the cutters rotate. A sufficient supply of uncontaminated lubricant should be maintained proximate the bearing systems throughout the lifetime of the bit. Various forms of seals have been provided between the cone cutters and the bearing pins upon which they are mounted to retain lubricant and prevent contamination; however, the need for new sealing systems is as acute today as any time in the history of rock drilling.

A rolling cone cutter earth boring bit must operate under very severe conditions, and the size and geometry of the bit is restricted by the operating characteristics. At the same time, a longer lifetime and improved performance is needed from the bit. In attempting to provide an improved bit, new and improved materials have been developed for the cutting structure of the cone cutters. They have provided a longer useful lifetime for the cone cutters. This has resulted in the bearing systems of the bit being often the first to fail during the drilling operation. Consequently, a need exists for new and improved bearing systems to extend the useful lifetime of the bit and to allow development of other elements that interact with the sealing and bearing systems. In attempting to improve the bearing systems, various seal systems have been provided to maintain the bearing area free of harmful materials and retain lubricant. In attempting to provide new sealing systems, great care must be taken that the overall capacity of the bearing systems is not reduced.

In order to more fully appreciate the problems involved in providing new sealing systems for rolling cone earth boring bits, the following factors should be borne in mind. An entirely effective system for sealing bit bearings (especially with non-friction elements such as balls and rollers) has, to date, eluded designers. Relatively loose manufacturing tolerances inherently necessary in such bearing assemblies create sealing problems that have not been satisfactorily solved. The required manufacturing tolerances preclude effective use of the many common shaft sealing methods due to the limited ability of shaft seals to accept loose radial fits while still maintaining an effective sealing condition. Bit designers have thus limited non-friction bearing sealing methods to face type seals, usually of the rubber coated belleville spring urged type since this type consumes a minimum of space. However, this rubber coated spring has been only moderately successful because the rubber sealing element is subject to rapid deterioration both through friction heating and through abrasion from exposure to the very deleterious environment encountered in oil well or blast hole drilling operations. Some single element elastomer urged metal-to-metal arrangements have been tried but these have generally met with poor success since one of the mating metal faces has to be incorporated into the arm or cone of the rock bit and the necessary highly finished lapped surfaces create special problems that the rock bit manufacturer cannot solve economically.

Thus is can be seen that, to date, face type seals have not provided the long life and sealing efficiency necessary for non-friction bearings. A result has been that bit designers have opted to switch to high accuracy tight fitting friction type journal bearings using shaft seals such as rubber O-rings, and with these they have had a relatively high degree of success but only in areas where proper cooling, such as a circulating liquid, can be supplied to the bit exterior environment. In blast holes where air is the circulating media, cooling around the body of the bit is not adequate to allow use of friction type bearings and when these sealed and lubricated friction bearing bits are used in a blast hole application, the bit soon heats up to an intolerable extent causing the elastomers in the seals to fail, followed quickly by failure of the bit bearings.

Designers of blast hole bits have continued using non-friction bearings in blast hole bit bearing assemblies because of the foregoing considerations. Since it is desirable that these bearings be fitted with a maximum size and quantity of rolling elements to withstand the very heavy loads imposed while at the same time yielding to the hole size limitations specified by the user, a classic designers dilemma of adapting a maximum capacity bearing in a minimum of space is produced. This dilemma invariably leads to compromises which circumvent many of the well known requirements for proper assembly and use of high precision non-friction rolling elememt bearings. Normal basic requirements, such as provisions for preload adjustments are considered impractical in rock bit bearings due to space limitations. Thus the blast hole rock bit designer compromises his instinctive desire for high precision guided element bearings to the reality of his need for maximum capacity (i.e., maximum possible quantity of ball and roller elements consistent with his special constraints) requiring him to accept a tolerance build-up across the bearing races of ten to twelve thousandths of an inch. This tolerance accumulation though reasonable, is still far too much for effective operation of many forms of shaft seals.

DESCRIPTION OF PRIOR ART

In U.S. Pat. No. 3,761,145 to Percy W. Schumacher, Jr., patented Sept. 25, 1973, a drill bit seal means is shown. A drill bit including a roller cutter mounted on a greased bearing journal having a grease seal ring therearound and resilient means mounted between the seal ring and bearing journal to urge the seal ring against a sealing surface on the cutter in such a manner that the seal ring may be forced away from the cutter surface by some predetermined pressure from within the cutter but wherein the seal ring arrangement provides a substantially positive seal from pressures externally of the cutter to prevent detritus or other foreign material from entering into the bearing area interiorly of the drill bit cutter is provided. Elastomeric material may be provided between the seal ring and the cutter sealing surface.

In U.S. Pat. No. 3,656,764 to William P. Robinson, patented Apr. 18, 1972, a seal assembly for a drill bit is shown. An earth boring drill bit employing roller cutters is provided with an improved seal for inhibiting ingress of abrasive materials into the bearing surfaces and egress of lubricant. The improved seal is between an outwardly facing re-entrant corner on the journal and an inwardly facing re-entrant corner on the cutter. The seal is made by a pair of O-rings engaging the opposed re-entrant corners and separated by a floating rigid ring having opposed bearing surfaces for seating the O-rings into the corners. This seal accommodates radial, axial, and angular displacements of almost twice the magnitude that can be accommodated by a single O-ring of the size of one of the O-rings without significantly increasing the length of journal needed for the seal.

DESCRIPTION OF OTHER ART

The present invention is within the rolling cone cutter earth boring bit art and the other art described below is not relevant prior art; however, a review of this art should prove helpful in understanding the present invention. In U.S. Pat. No. 3,073,657 to R. V. Oxford, patented Jan. 15, 1963, a rotary seal is shown. In U.S. Pat. No. 3,073,689 patented Jan. 15, 1963, a method of producing mating sealing surfaces is shown. In U.S. Pat. No. 3,216,513, patented Nov. 9, 1965, a rotary wheel type rock cutter for tunnel boring and raise drilling operations is shown.

SUMMARY OF THE INVENTION

The present invention provides a sealing system for a rolling cone cutter earth boring bit that acts as a barrier to the pulverized cuttings and other abrasive materials in the borehole to prevent these materials from entering the bearing area of the bit and retains lubricant within said bearing area. At least one cantilevered bearing pin extends from the bit body. A cutter receiving surface is located on the arm. A first shallow annular groove is located in said cutter receiving surface. A rolling cone cutter is adapted to be rotatably mounted on the bearing pin with said rolling cone cutter having a cone mouth. A second shallow annular groove is located within said cone mouth. Bearing and cutter retaining means are located between the bearing pin and the cone cutter. A first seal unit is positioned around the bearing pin between the cutter receiving surface and the rolling cone cutter. The first seal unit includes a first annular rigid ring positioned around the bearing pin and a first resilient ring located in the first shallow annular groove between the first annular rigid ring and the cutter receiving surface. A second seal unit is positioned around the bearing pin and located within the cone mouth. The second seal unit includes a second annular rigid ring positioned around the bearing pin within the cone mouth and a second resilient ring located in the second shallow annular groove between the second annular rigid ring and the cone mouth. The first and second seal units cooperate when the rolling cone cutter is mounted on the bearing pin so that the first and second resilient rings urge the first and second annular rigid rings into sliding contact as the cone cutter rotates about the bearing pin. An oil-flooded bearing is provided with relatively large reservoir capacity and upward flow passageways that provide maximum protection against heat build-up in the bearing. In the event of excess heat the oil can be purged easily through a filler hole after several blast holes have been completed thereby maximizing bearing life.

The unique seal of the present invention can be shown to have a number of important features not existing in the prior art. It is, however, to be understood that the scope of the present invention is defined by the claims at the end of this specification and the following description of the distinctions over the prior art is not to be interpreted as limiting the coverage of the present invention. The seal face is metal-to-metal, ceramic-to-metal, ceramic-to-ceramic or some other rigid minimum friction combination which is a vast improvement over the rubber-to-metal combinations heretofore used in current state-of-the-art face seals for non-friction bearing bits. Seal faces, in addition, can be ground and lapped in matched sets to a high precision finish which virtually guarantees tight effective sealing. The elastomer urged sealing faces provide maximum adaptability to misalignment and built-in bearing "slop", a quality which is essential for proper lubricant isolation in a rock bit cone that is subjected during operation to constantly fluctuating multi-directional forces causing a high degree of "wobble" on the journal pin. The seal and bearing are designed such that there is maximum protection of the seal group from the adverse environment as encountered in usual practice in blast hole drilling. This protection is provided by a minimal clearance labrynthe passageway outboard of the seal cluster. Minimizing the seal group cross section and designing a special completely sealed oil-filled reservoir in order to adapt a total package of an elastomer urged seal group, anti-friction bearings and a special oil-filled reservoir configuration to a rock bit bearing is a completely new approach in rotary rock bit sealing technology. The above and other features and advantages of the present invention will become apparent upon consideration of the following detailed description of the invention when taken in conjunction with the accompanying drawings.

DETAILED DESCRIPTION OF THE INVENTION

Figures 1, 2:
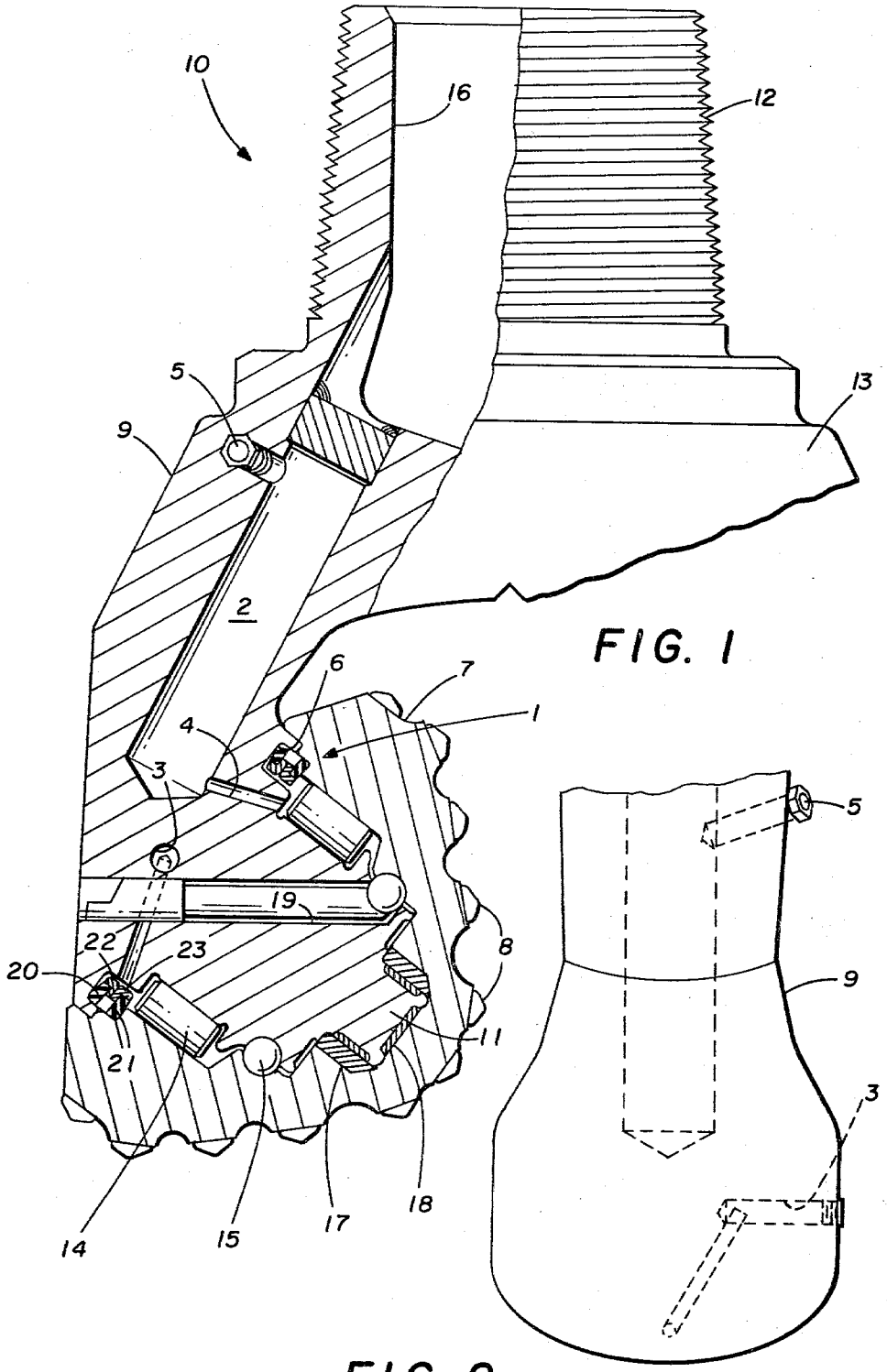
FIG. 1 is an illustration, partially in section, of an earth boring bit constructed in accordance with the present invention.
FIG. 2 is a side view of the arm of the bit shown in FIG. 1.

Referring now to FIG. 1, a sectional view of one arm of a rolling cone earth boring bit 10 embodying the present invention is shown. The rolling cone cutter earth boring bit 10 consists of a main bit body 13 adapted to be connected to a rotary drill string. The bit 10 includes individual rotatable cone cutters mounted on individual bearing pins extending from the main bit body. A sealing system acts as a barrier to the pulverized cuttings and other abrasive materials in the borehole to prevent these materials from entering the bearing area of the bit and retains lubricant within the bearing area. A double urged seal group is provided. While embodying well known features, this seal group has never been adapted for rock bits. Prior double floating elastomer urged metal-to-metal seal groups required space envelopes too large to fit the limited space available in a rock bit cone bearing. Applicant's work has culminated in the development of a seal group to dimensions that are scaled down to fit a considerably reduced seal envelope. This small seal envelope has resulted in a minimum negative impact on total cone bearing load capacity.

The body 13 of the bit 10 includes an upper threaded portion 12 that allows the bit 10 to be connected to the lower end of a rotary drill string (not shown). The bit 10 also includes a central passageway 16 extending along the central axis of the bit to allow drilling fluid to enter from the upper section of the drill string (not shown) immediately above and pass downward to the bottom of the well bore to flush cuttings and drilling debris from the well bore. A depending arm 9 extends from body 12. It is to be understood that the structure of the other arms are substantially identical to the arm 9 shown in FIG. 1. A cutter 7 is rotatably positioned on the bearing pin 11 extending from the arm 9 and adapted to disintegrate the earth formations as the bit 10 is rotated. The bearing pin 11 projects from the cutter receiving surface of the arm. The cutting structure on the surface of the cutter contacts and disintegrates the formations in a manner that is well known in the art. The cutting structure is shown in the form of tungsten carbide inserts 8. It is to be understood that other cutting structures such as steel teeth may be used as the cutting structure on the cone cutter 7.

A plurality of bearing systems are located in the bearing area between the cutter 7 and the bearing pin 11. The bearing systems in the bearing area include an outer roller bearing 14, a series of ball bearings 15, an inner friction bearing 17, and a thrust button 18. A passageway 4 is provided to allow lubricant to be transmitted to the bearing systems. Another passageway 19 is also provided that allows the balls that make up the ball bearing system 15 to be inserted into position after the cone cutter 7 is placed on the bearing pin 11. The series of ball bearings serves to lock the cone cutter on the bearing pin. After the balls are in place, a plug is inserted into the passageway 19 and welded therein.

A seal group 1 of the full floating double elastomer urged metal face-to-metal face (or ceramic face-to-metal face or ceramic face-to-ceramic face or graphite-to-metal or graphite-to-graphite being some of the possible alternatives) is located between the arm 9 and cutter 7. The seal group 1 is miniturized and adapted for use in a rock bit in a manner that minimizes the loss of bearing capacity of the rock bit by minimizing the space loss to the seal in the bearing envelope. The seal group 1 uses seal parts (sealing rings) that are ground and lapped in matched sets for very high sealing effectiveness. The seal group 1 includes a first seal unit positioned around the bearing pin 11 between the cutter receiving surface and the rolling cone cutter 7. The first seal unit comprises a first annular rigid ring 22 positioned around the bearing pin 11 and a first resilient ring 20 located in a first shallow annular groove 6 between the first annular rigid ring 22 and the cutter receiving surface. A second seal unit is positioned around the bearing pin 11 within the cone mouth. The second seal unit comprises a second annular rigid ring 23 positioned around the bearing pin 11 within the cone mouth and a second resilient ring 21 located in the second shallow annular groove between the second annular rigid ring 23 and the cone mouth. The first and second seal units cooperate when the rolling cone cutter 7 is mounted on the bearing pin 11. The first and second resilient rings urge the first and second annular rigid rings into sliding contact as the cone cutter rotates about the bearing pin.

An oil-flooded bearing with relatively large reservoir capacity and upward flow passageways provides maximum protection against heat build-up in the bearing. In the event of excess heat the oil can be purged easily through a filler hole after several blast holes have been completed thereby maximizing bearing life. As best understood by reference to both FIGS. 1 and 2, a bore 2 extends into the body 12 from the internal surface of the bit body. The passage 4 extends from the bore 2 to the bearing area. A lubricant reservoir is located in the bore. Lubricant within the lubricant reservoir 2 is channeled into the passage 4 and is directed to the bearings. The reservoir 2 is completely or almost completely filled with a high viscosity oil.

A reservoir filling system allows new oil to be introduced into the bearings during the lifetime of the bit. The new oil will be introduced at the lowermost portion of the bearing cluster through passage 3. This is the critical load carrying portion. The oil will flow upward through the bearing clearances and through passage 4. The passage 4 angles upward and is located at the uppermost portion of the bearing cluster. This will completely flush the bearings forcing all old oil into the reservoir 2 and ultimately out of the reservoir through pressure relief valve 5.

The structural details of an earth boring bit 10 constructed in accordance with the present invention having been described, the operation of the bit 10 will now be considered. The lubrication system of the bit 10 is filled with a suitable lubricant. The bit is rotated and thrust downward, thrusting the cutter 7 against the earth formations. Continued rotation with the drill string applying a thrust force to the bit causes the cutters to disintegrate the formations and form the desired borehole. The present invention provides a seal unit 1 in the cone mouth of the bit 10 which will act as a barrier to the pulverized cuttings, the borehole fluid and any other materials in the borehole. The seal unit 1 acts to prevent these materials from entering the bearing area through the cone mouth opening, thus providing an uncontaminated environment for the metal bearing elements and eliminating the abrasive wearing action of foreign materials in the bearing area. The lubricant is retained within the bit by the seal unit 1 to assure a long lifetime for the bearing systems. The oil within the bearing systems and the reservoir may be replaced by introducing new oil through passage 3. The new oil forces all old oil out of the bit through relief valve 5.

The embodiments of the invention in which an exclusive property or privilege is claimed are defined as follows:

1. A rolling cone cutter earth boring bit, comprising:
   - an annular bit body having an upper externally threaded portion and a central passage in said bit body;
   - at least one arm extending downwardly from said bit body and terminating in an inwardly downwardly projecting cylindrical bearing pin;
   - an annular groove in said arm at the root portion of said bearing pin;
   - a cone cutter rotatably mounted on said cylindrical bearing pin and having an open ended cavity providing a cone mouth adjacent said root portion with said rolling cone cutter substantially surrounding said bearing pin;
   - an annular shoulder within said cone mouth adjacent to and concentric with said annular groove bearing;

cutter retaining means interposed between said bearing pin and said rolling cone cutter;

a seal assembly disposed in said aligned groove and shoulder between said bearing pin and said rolling cone cutter, said seal assembly including a first seal unit comprising a first annular rigid ring in said groove and a first resilient ring in sealing engagement between said groove and said first rigid ring, and a second seal unit comprising a second annular rigid ring positioned in said shoulder and a second resilient ring in sealing engagement between said shoulder and said second rigid ring, and, said first and second rigid rings of said seal units providing a relatively moveable sealing interface therebetween when said rolling cone cutter is mounted on said bearing pin whereby said first and second resilient rings urge said first and second annular rigid rings into sliding contact as said cone cutter rotates about said bearing pin;

a lubricant reservoir in said bit body;

a first upper lubricant flow passage connecting said lubricant reservoir and said bearing and cutter retaining means;

a relief valve connecting said lubricant reservoir with the outside of said bit;

a second lubricant flow passage extending from outside said arm to immediately adjacent said sealing interface on the lubricant side thereof and generally opposite said upper passage for introducing new lubricant into said bit; and a plug for closing said second passage whereby new oil introduced from said second passage must flow adjacent the sealing interface and across the bearings to flush the previous oil therefrom for expulsion through said relief valve.

2. Structure according to claim 1 wherein said second lubricant flow passage terminates in generally the lowermost area of said sealing interface corresponding to the critical load-carrying portion of said bearing for insuring delivery of new lubricant to this area when new lubricant is introduced through the second passage.

* * * * *